US009278774B2

(12) United States Patent
Fairchild, Jr.

(10) Patent No.: US 9,278,774 B2
(45) Date of Patent: Mar. 8, 2016

(54) CLAMSHELL CARTON WITH LOCKING TAB

(71) Applicant: Huhtamaki, Inc., De Soto, KS (US)

(72) Inventor: Robert L. Fairchild, Jr., Middletown, OH (US)

(73) Assignee: HUHTAMAKI, INC., De Soto, KS (US)

( * ) Notice: Subject to any disclaimer, the term of this patent is extended or adjusted under 35 U.S.C. 154(b) by 0 days.

(21) Appl. No.: 14/295,945

(22) Filed: Jun. 4, 2014

(65) Prior Publication Data

US 2014/0353367 A1 Dec. 4, 2014

Related U.S. Application Data

(60) Provisional application No. 61/830,725, filed on Jun. 4, 2013.

(51) Int. Cl.

| | |
|---|---|
| ***B65D 5/66*** | (2006.01) |
| ***B65D 5/20*** | (2006.01) |
| ***B65D 5/28*** | (2006.01) |

(52) U.S. Cl.

CPC ..... *B65D 5/6608* (2013.01); *B65D 5/2047* (2013.01); *B65D 5/28* (2013.01); *B65D 5/667* (2013.01); *B65D 5/66* (2013.01)

(58) Field of Classification Search

USPC ..... 229/920, 931, 125.29, 125.28, 902, 229/153, 904

See application file for complete search history.

(56) References Cited

U.S. PATENT DOCUMENTS

| | | | | | |
|---|---|---|---|---|---|
| 2,177,993 | A | * | 10/1939 | Olsen | 229/117.19 |
| 4,232,816 | A | * | 11/1980 | Johnson et al. | 229/114 |
| 4,431,128 | A | * | 2/1984 | Dirico | 229/120.03 |
| 4,472,896 | A | * | 9/1984 | Brauner et al. | 40/312 |
| 5,431,333 | A | * | 7/1995 | Lorenz | 229/114 |

OTHER PUBLICATIONS

Photos of Hamburger Clamshell and Hot Dog Clamshells, http://www2.us.huhtamaki.com, 3 pages, Huhtamaki Food Group 2013.

* cited by examiner

*Primary Examiner* — Christopher Demeree
(74) *Attorney, Agent, or Firm* — Husch Blackwell LLP

(57) ABSTRACT

A carton assembled from a foldable blank including a base having a bottom panel and a plurality of walls and a lid having a top panel and a plurality of walls. The carton may include a tab extending from one of the plurality of walls of the base. The lid may have a slit defined proximate a fold line, the fold line being where at least one of the plurality of walls of the lid meet the top panel, and the slit may be adapted for receiving all or part of the tab therethrough. The lid may also have a slot disposed on the top panel and inward of the slit. After being received through the slit, the tab can be folded about the fold line to lie substantially parallel to the top panel of the lid and a distal end of the tab may be inserted into the slot.

14 Claims, 9 Drawing Sheets

CLAMSHELL CARTON WITH LOCKING TAB

CROSS-REFERENCE TO RELATED APPLICATIONS

This application claims the benefit of U.S. Provisional Patent Application Ser. No. 61/830,725, filed on Jun. 4, 2013, to Robert L. Fairchild, Jr., entitled "Clamshell Carton with Locking Tab," the entire disclosure of which is hereby incorporated by reference.

FIELD OF THE INVENTION

The present invention is directed toward an improved clamshell carton which may preferably be made of paperboard or similar materials. Such clamshell cartons are often used in the fast food industry to contain and serve food items. However, such clamshell cartons may be made from other materials and may have many alternative uses.

BACKGROUND OF THE INVENTION

Foldable clamshell cartons are used in the packaging industry with prolific use in the fast food industry. Foldable clamshell cartons constructed of paperboard are becoming more popular due to the fact that they can be shipped in an unfolded state and assembled on premises, are lighter weight, and/or consume less shipping volume. These characteristics may individually or collectively reduce manufacturing and/or shipping costs. Current foldable clamshell cartons usually have a catch arranged between the free edges of the front panels of the lid portion and the base portion. The catch may be positioned in the corners or the middle of the front panels and at a location where the lid portion otherwise overlaps or meets with the base portion. These catches are typically sufficient to keep the lid portion from becoming disengaged with the base portion when the carton is not being handled. However, the lid portion and the base portion often become spontaneously disengaged due to residual elastic forces present in the material if the folds are not fully completed or become deformed. Further, the lid portion often disengages the base portion causing spillage of the contents of the carton upon applying a lifting force to the lid or a constricting force upon the sidewalls to grip the carton, such as the forces required to remove the carton from a paper or plastic bag.

Thus, there is a need in the art to provide a foldable clamshell carton having an improved locked position to prevent the disengagement of the lid portion from the base portion during handling and transport of the foldable clamshell carton and the contents thereof.

SUMMARY OF THE INVENTION

The present application is directed toward a clamshell carton assembled from a foldable blank. The carton includes a base and a lid. The base generally includes a bottom panel and a plurality of walls extending upwardly therefrom when the carton is in an assembled and closed position. The lid generally includes a top panel and a plurality of walls extending downwardly therefrom when the carton is in an assembled and closed position. In one embodiment, the carton may include four walls. However, other embodiments may include other wall configurations, such as three walls or more than four walls.

The base may include a tab extending from one of the plurality of base walls. The tab may generally have a width and a length and may have the shape of a trademark or logo of a retailer. The transition between the wall and the tab may be defined by a score line. The score line may make it easier to fold the tab relative to the wall. The length of the tab may be defined from the score line to the distal end of the tab, wherein the length may be greater than, less than or equal to a distance from a trailing edge of a front panel of the lid normal to the fold line between the front panel and top panel of the lid. The base may further include a height of its front panel being substantially similar of the sum of a height of a rear panel of the base and a height of a rear panel of the lid.

The lid and the base of the carton may each include a fold line present at the intersection of each of the walls with the respective top and bottom panels. The fold lines may be disposed on the foldable blank during manufacturing and allow the carton to be easily folded at those locations. The lid may also have a slit defined therein proximate one of the fold lines. The lid may also have a slot cut into the top panel inward of the slit. The slot may be parallel to the slit. The slot may be configured for receiving a distal end of the tab.

The tab and the slit may be arranged on the foldable blank so that they align when the carton is in a folded position. The slit may be sized and adapted for receiving the tab therethrough to facilitate the retention of the lid in a closed position. In one embodiment, the tab is arranged on the front panel of the base and the score line may be located near or at the upper edge of the front panel of the base. The slit may be arranged proximate the fold line between the front panel and the top panel of the lid. The slot may be arranged parallel to and/or inward of the slit. However, the tab may be disposed on any of the walls of the base and the slit may be disposed proximate any fold line of the lid opposite the tab.

In one embodiment, the front panel of the lid may include a window area defined therein. In another embodiment, the window area may correspond in shape with the tab to reduce waste when cutting out the foldable blank from the stock material.

When the present carton is assembled, the carton may include a locked position, wherein the locked position includes the tab being received into the slit, the tab being folded at the score line, the tab being orientated substantially parallel to the top panel of the lid, and the terminal end of the tab received into the slot in the top panel of the lid.

Other aspects and advantages of the present invention will be apparent from the following detailed description of the preferred embodiments and the accompanying drawing figures.

DESCRIPTION OF THE SEVERAL VIEWS OF THE DRAWING

In the accompanying drawing, which forms a part of the specification and is to be read in conjunction therewith in which like reference numerals are used to indicate like or similar parts in the various views.

DETAILED DESCRIPTION OF THE INVENTION

Figure 1:
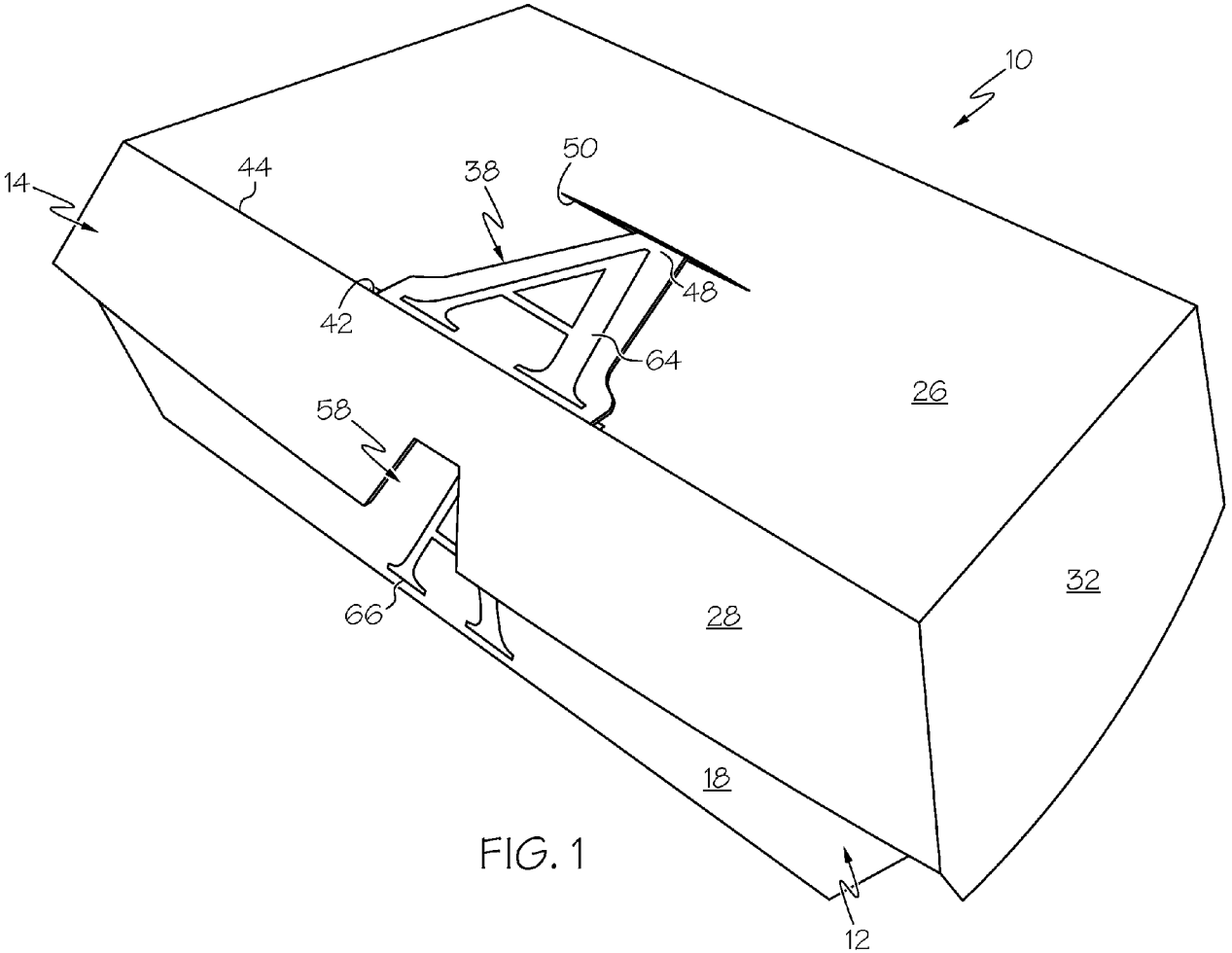
FIG. 1 is a top perspective view of a clamshell carton with locking tab illustrating the carton in a closed and locked orientation in accordance with a first embodiment of the present invention.

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

The following detailed description of the invention references specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

Referring to the figures, one embodiment of the present invention is directed to a clamshell carton 10 having a tray or base 12 hingedly attached to a cover or lid 14. As discussed in greater detail below, the carton 10 includes a unique latch or lock construction for retaining the lid 14 in a closed orientation relative to the base 12.

Figure 2:
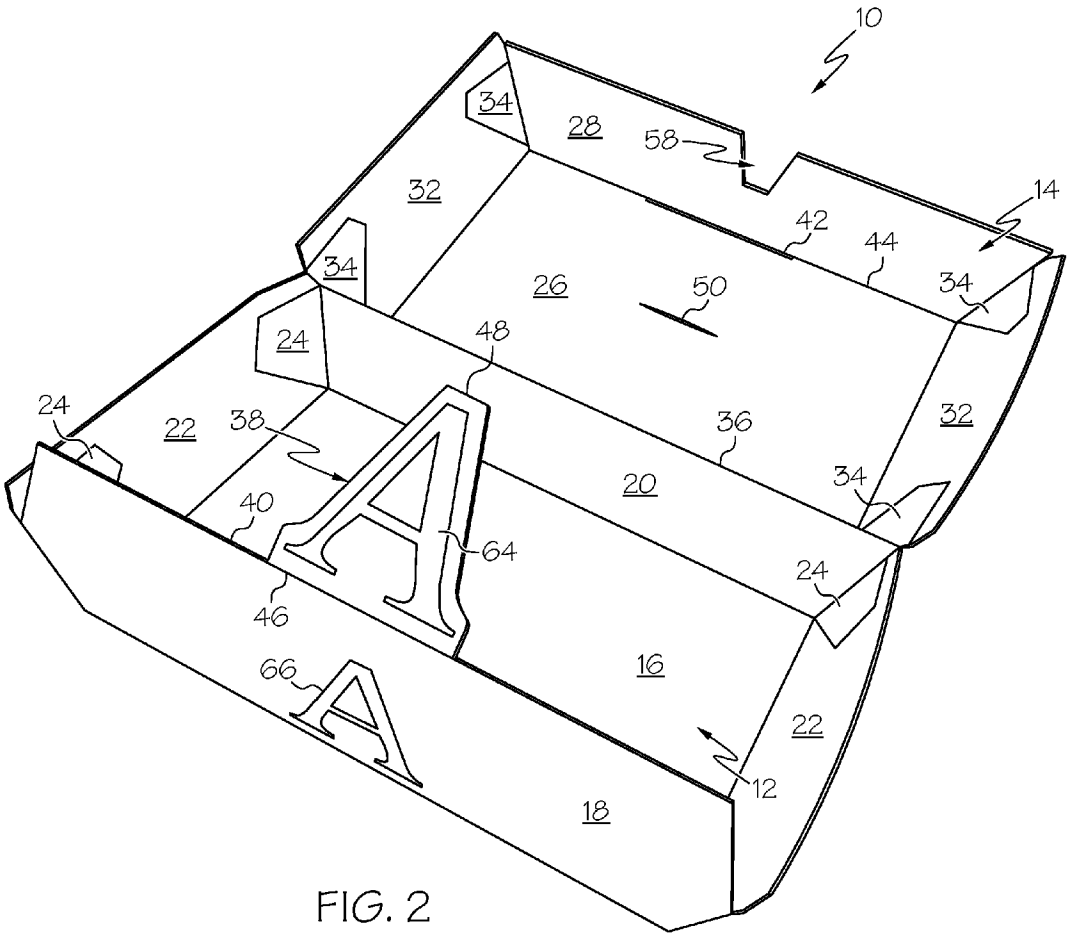
FIG. 2 is a top perspective view of a clamshell carton of FIG. 1 illustrating the carton in an open orientation in accordance with a first embodiment of the present invention.

As shown in FIG. 2, the base 12 includes a bottom panel 16 from which a front panel 18, rear panel 20 and opposing side panels 22 extend upwardly therefrom. Glue tabs 24 may be provided for adhesively joining the side panels 22 with the front and rear panels 18 and 20. The lid 14 includes a top panel 26 from which a front panel 28, rear panel 30 (see FIG. 5) and opposing side panels 32 extend downwardly therefrom when top panel 26 is disposed opposite and above bottom panel 16 as shown in FIG. 1. Lid 14 may also include a plurality of glue tabs 34 extending from side panels 32 and/or front and rear panels 28, 30 for adhesively joining the side panels 32 with the front and rear panels 28 and 30. Rear panel 30 of the lid 14 is foldably secured to the rear panel 20 of the base 12 by a hinge line 36.

Figure 5:
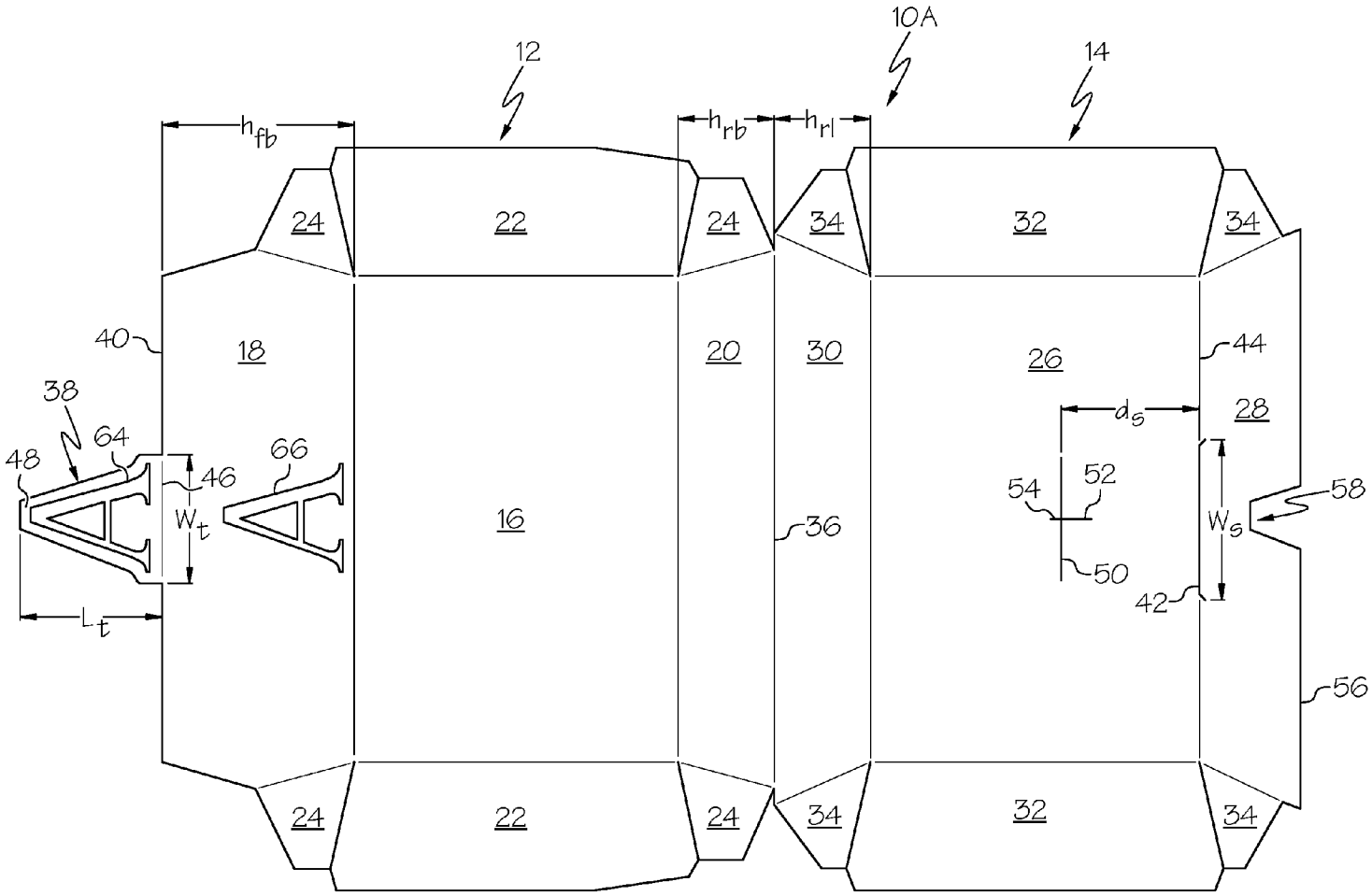
FIG. 5 is a top plan view of a blank used to form a clamshell carton with a locking tab in accordance with a first embodiment of the present invention.

As illustrated best in FIGS. 2 and 5, the locking construction of the carton 10 includes a tab 38 extending from an upper edge 40 of base front panel 18. While shown as having a generally triangular or "A" shape, it will be understood that the tab 38 may be of any suitable shape and may be shaped to accommodate a recognizable trade symbol or artwork design 64. A first cut or slit 42 is provided in top panel 26 proximate the fold line 44 joining the front panel 28 and top panel 26 of the lid 14. A shown in FIG. 5, the width $w_s$ of the slit 42 corresponds to the width $w_t$ of the tab 38, as shown in FIG. 5, and is at least wide enough to allow the tab 38 to extend substantially through the slit 42.

Figure 3:
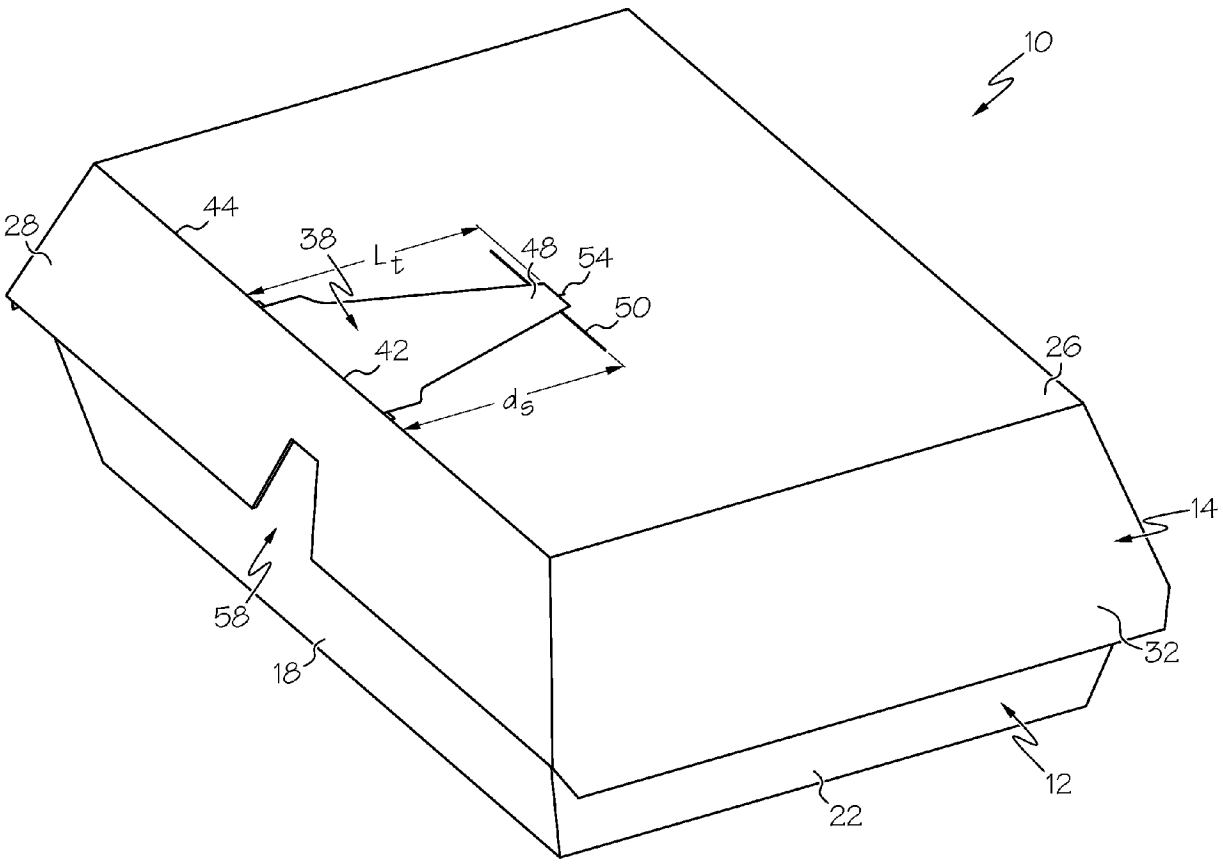
FIG. 3 is a top perspective view of a clamshell carton with locking tab illustrating the carton in a closed and partially locked orientation in accordance with a first embodiment of the present invention.
Figure 4:
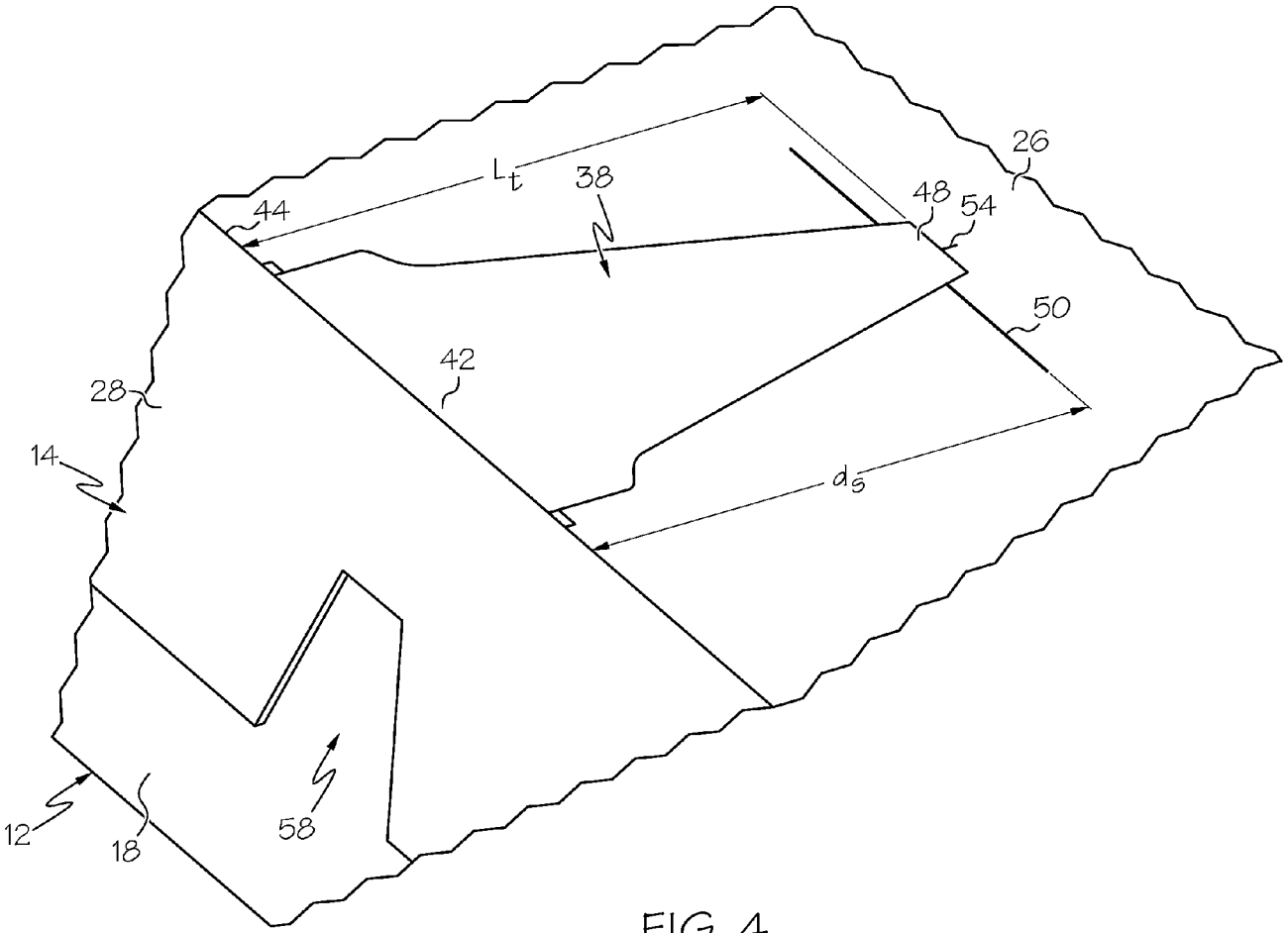
FIG. 4 is an enlarged top perspective view illustrating the locking tab and slot of the clamshell carton in accordance with a first embodiment of the present invention.

As demonstrated in FIG. 1, when the carton 10 is in a closed orientation, the tab 38 may extend through the slit 42. The tab 38 can then be folded along its base at score line 46 (see FIG. 5) such that the tab 38 lies generally parallel to the top panel 26 of the lid 14. A distal end 48 of the tab 38 can then be inserted or tucked into a second cut or slot 50 formed into the top panel 26 of the lid 14. As shown in FIGS. 3 and 4, the length $l_t$ of the tab 38 is slightly longer that the distance $d_s$ between the slot 50 and fold line 44.

As shown in FIG. 5, additional cuts 52 and 54 intersecting slot 50 may be provided so that when the tab 38 lies flat on the top panel 26, a user may push the end 48 of the tab generally downwardly to effectuate the engagement or tucking of the end 48 of the tab 38 into the slot 50. When the tab 38 is inserted into the slot 50, the tab 38 acts as a strap to hold the lid 14 closed with respect to the base 12.

In one embodiment best shown in FIG. 5, the front panel 18 of the base 12 has a height $h_{fb}$, that is approximately equal to the combined heights $k_{rb}$ and $h_{rl}$ of the rear panels 20 and 30 of the base 12 and lid 14 such that when the carton 10 is in a closed orientation, the top edge 40 of the front panel 18 extends to and is positioned generally against the fold line 44. This positions the score line 46 of the tab 38 is the same general axis as the fold line 44 of the lid 14 thereby enabling the tab 38 to be pivotally folded downwardly at fold line 46 when the lid 14 is in a closed position.

Figure 6:
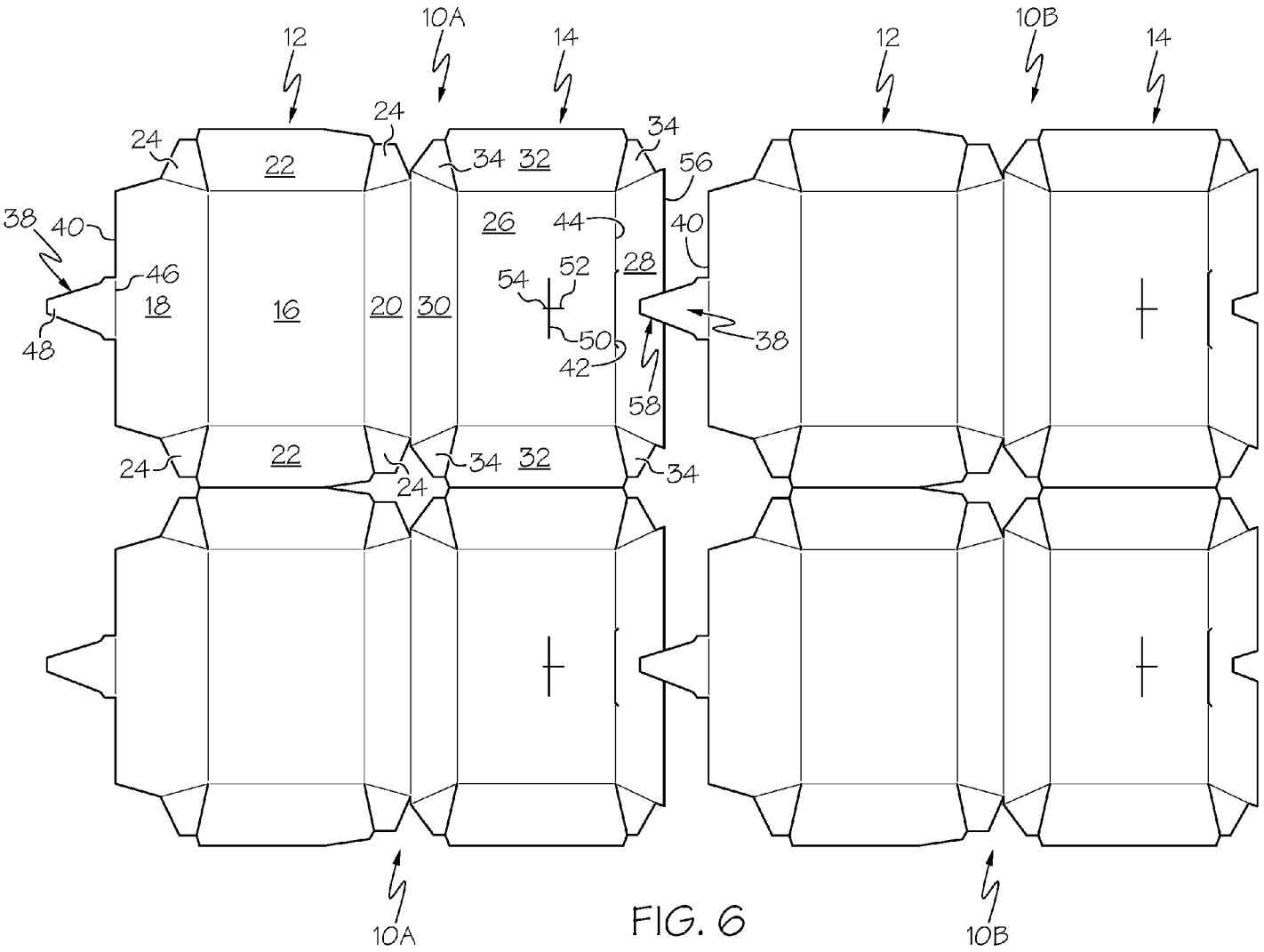
FIG. 6 is a top plan view of a diagram illustrating a plurality of blanks as they may be cut from a single sheet or roll of paperboard in accordance with a first embodiment of the present invention.

As further shown in FIG. 5, the carton 10 can be constructed from a flat blank of material that may be formed of paperboard or other suitable material. FIG. 6 illustrates a layout diagram comprising multiple blanks 10A and 10B as they may be cut from a single sheet or roll of material. It will be understood that, depending on the width of the roll, either more or less than two blanks 10A and 10B may be positioned across the width of the roll. As shown in FIG. 6, the tab 38 of a trailing blank 10B may be cut, at least partially, from the front panel 28 of the lid 14 of a leading blank 10A. In one embodiment, the tab 38 is of a length $l_t$ such that the leading edge 40 of a trailing blank 10B abuts the trailing edge 56 of a leading blank 10A in order to even further reduce or eliminate paper waste between the blanks 10A and 10B.

It will be appreciated that the tab 38 can be shaped to represent or accommodate the printing of a trade symbol or artwork design 64 (represented for illustrative purposes by an "A" in FIGS. 1, 2 and 5) of a particular food vendor. Further, because the tab 38 of one blank 10B may be cut from the front panel 28 of the lid 14 of another blank 10A, the front panel 28 may include a window area 58 defined therein. The window area 58 may correspond in shape with a distal portion of the tab 38. The inclusion of window area 58 provides the ability to print an additional trade symbol or artwork design 66 on the front panel 18 of the base 12 that will be visible through this window area 58 as demonstrated in FIG. 1. Conversely, if such a window area 58 is not desirable, the tab 38 of a trailing blank 10B need not be cut from the front panel front 28 of the lid 14 of a leading blank 10A, thereby resulting in an uninterrupted surface in the front panel 28.

Figure 7:
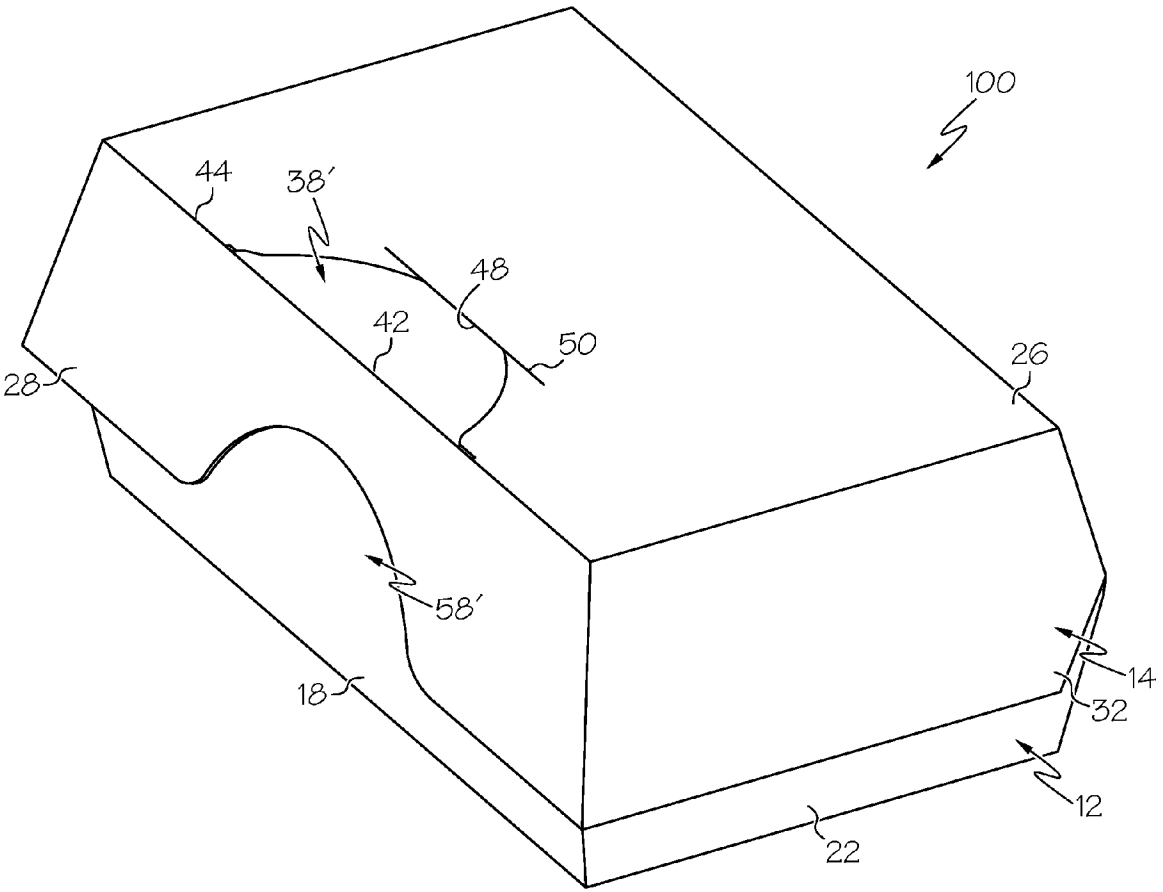
FIG. 7 is a top perspective view of a clamshell carton with locking tab illustrating the carton in a closed and locked orientation in accordance with a second embodiment of the present invention.
Figure 8:
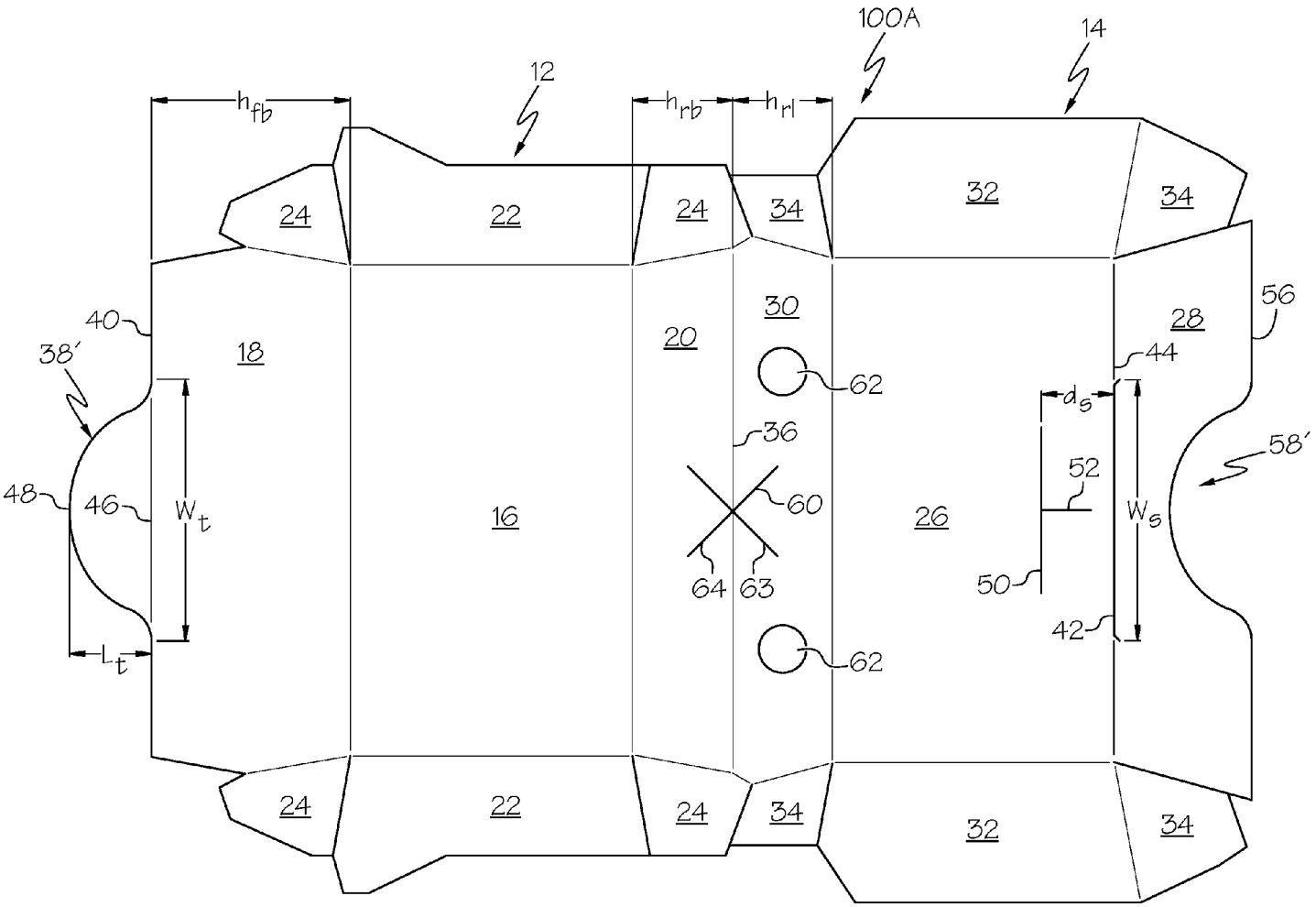
FIG. 8 is a top plan view of a blank used to form a clamshell carton with a locking tab in accordance with a second embodiment of the present invention.
Figure 9:
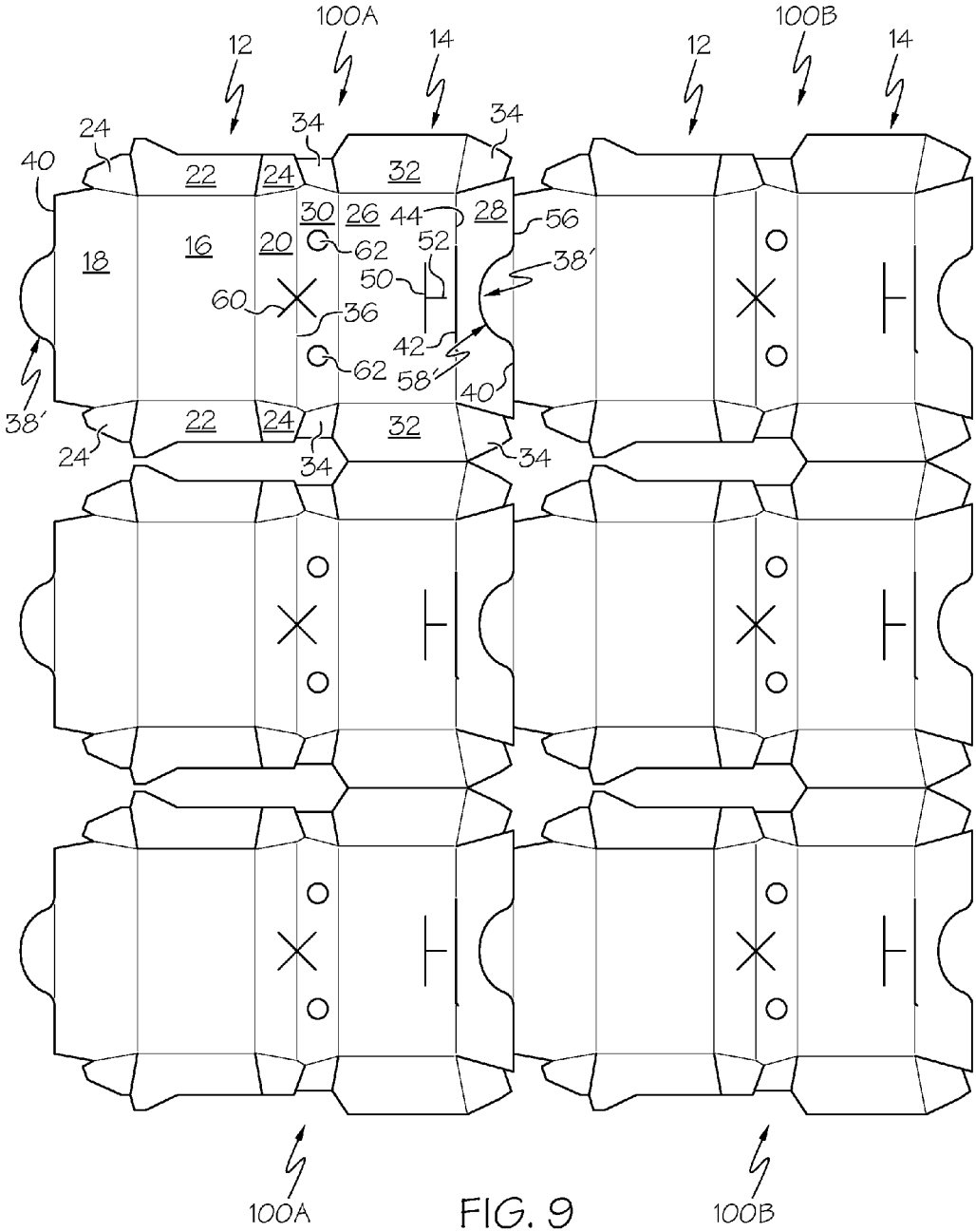
FIG. 9 is a top plan view of a diagram illustrating a plurality of blanks as they may be cut from a single sheet or roll of paperboard in accordance with a second embodiment of the present invention.

FIGS. 7-12 illustrate a second embodiment of a carton 100, which is similar in nature to the carton 10 shown in FIGS. 1-6. As shown in FIG. 7, the shape and placement of the locking construction of carton 100 differs from that of carton 10. For example, as shown in FIG. 8, the tab 38' may be of a shorter length $l_t$. As shown in FIG. 9, the shorter length $l_t$ allows the leading edge 40 of a trailing blank 100B to abut the trailing edge 56 of a leading blank 100A in order to reduce or eliminate paper waste between the blanks 100A and 100B when tab 38' corresponds in shape with window 58' as shown in FIG. 9. Accordingly, the distance $d_s$ between the slot 50 and fold line 44 is reduced so that such distance $d_s$ remains slightly less than the length $l_t$ of the tab 38' thereby permitting the end 48 of the tab 38' to be inserted into the slot 50. In addition, tab 38' may have a wider width $w_t$ so as to provide a wider extent of the hold down action provided by the locking mechanism of the present carton 100. Additionally, as set forth above, the tab 38' can be of any desired shape, including arc-shaped, as depicted in FIGS. 7-10.

As shown in FIG. 8, the carton 100 may further include an anti-binding feature 60 and vents 62 that may be selectively opened or removed. As shown in FIG. 8, anti-binding feature 60 may include crossing slits 63 and 64 wherein the crossing slits intersect proximate hinge line 36. As shown in FIG. 8, vents 62 may be circular cut-outs or perforated portions of the rear panel 30 of lid 14. However, vents 62 may be disposed on rear panel 20 of base 12, side panels 22 or 32, front panels 18 or 28, bottom panel 16, or top panel 26.

Other and further embodiments of the present invention will also be appreciated. For example, the carton 10 or 100 may include more than one tab 38 or 38', slit 42 and slot 50, such that two or more locking mechanisms may be provided. In another embodiment, tab 38 or 38' may extend from a side panel 22 rather than a front panel 18. In a further embodiment, the tab 38 or 38' may extend from the front panel 28 or a side panel 32 of the lid 14 and a slit 42 and slot 50 may be defined in the bottom wall 16 of the base 12. In another embodiment, the present carton may comprise any number of walls extending from the top and bottom panel, with three walls being a common variation of the embodiments described above. The use of three walls allows for a triangular or pie-shaped carton.

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions described above and illustrated in the drawings are presented by way of example only and are not intended to limit the concepts and principles of the present invention. Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A foldable blank to be used for forming a carton, said blank comprising:

a base having a bottom panel and a plurality of walls extending therefrom, one of said plurality of walls comprising a rear panel and one of said plurality of walls comprising a front panel having an upper edge;

a lid operably connected to said base, said lid having a top panel and a plurality of walls extending therefrom, one of said plurality of walls comprising a rear panel and one of said plurality of walls comprising a front panel, said lid further including a fold line disposed between said front panel and said top panel;

a tab extending from said front panel of said base and foldable about a score line that is proximate to said upper edge of said front panel of said base;

a slit defined proximate said fold line of said lid, said slit adapted for receiving said tab therethrough to retain said lid in a closed position when said blank is assembled to form said carton; and a slot defined in said top panel, said slot being adapted for receiving a terminal end of said tab therethrough;

wherein a height of said front panel of said base is substantially similar to a sum of a height of said rear panel of said base and a height of said rear panel of said lid.

2. The foldable blank of claim 1 wherein said slot is substantially parallel to and spaced inward from said slit.

3. The foldable blank of claim 1 wherein a length of said tab is greater than a distance between said slit and said slot.

4. The foldable blank of claim 1 wherein a length of said tab is greater than a distance from a trailing edge of said front panel of said lid normal to said fold line.

5. The foldable blank of claim 1 wherein a length of said tab is less than a distance from a trailing edge of said front panel of said lid normal to said fold line.

6. The foldable blank of claim 5 wherein said front panel of said lid includes a window area defined therein, said window area corresponding in shape with said tab.

7. The foldable blank of claim 1 further comprising a window area corresponding in shape with a distal portion of said tab.

8. A carton assembled from a foldable blank, said carton comprising:

a base having a bottom panel and a plurality of walls extending upwardly therefrom, one of said plurality of walls comprising a rear panel and one of said plurality of walls comprising a front panel having a upper edge;

a lid operably connected to said base, said lid having a top panel and a plurality of walls extending downwardly therefrom, one of said plurality of walls comprising a rear panel and one of said plurality of walls comprising a front panel, said lid further including a fold line disposed between said front panel and said top panel;

a tab extending from said front panel of said base and foldable about a score line that is proximate to said upper edge of said front panel of said base;

a slit defined proximate said fold line, said slit adapted for receiving said tab therethrough to retain said lid in a closed position; and a slot defined in said top panel, said slot spaced from said slit and adapted for receiving a terminal end of said tab therethrough;

wherein a height of said front panel of said base is substantially similar to a sum of a height of said rear panel of said base and a height of said rear panel of said lid.

9. The carton of claim 8 wherein a length of said tab is greater than a distance from a trailing edge of said front panel of said lid normal to said fold line.

10. The carton of claim 8 wherein a length of said tab is less than a distance from a trailing edge of said front panel of said lid normal to said fold line.

11. The carton of claim 10 wherein said front panel of said lid includes a window area defined therein, said window area corresponding in shape with said tab.

12. The carton of claim 8 wherein said tab has a length greater than a distance between said slit and said slot.

13. The carton of claim 12 wherein said carton further comprises a locked position, said locked position comprising said tab received into said slit, said tab folded substantially parallel to said top panel of said lid, and said terminal end of said tab received into said slot.

14. A carton assembled from a foldable blank, said carton comprising:

a base having a bottom panel and a plurality of walls extending upwardly therefrom;

a lid operably connected to said base, said lid having a top panel and a plurality of walls extending downwardly therefrom, said lid further including a fold line at a location at which one of said plurality of walls of said lid meets said top panel;

a tab extending from one of said plurality of walls of said base;

a slit defined proximate said fold line, said slit adapted for receiving sad tab therethrough to retain said lid in a closed position;

a slot defined in said top panel, said slot spaced from said slit and adapted for revceiving a terminal end of said tab therethrough; and a window area corresponding in shape with a distal portion of said tab.

* * * * *